United States Patent [19]

Miyata et al.

[11] 4,124,289

[45] Nov. 7, 1978

[54] ELECTROPHOTOGRAPHIC COPYING APPARATUS

[75] Inventors: Shin Miyata; Takeji Morikawa, both of Toyokawa; Yoshihisa Kawai, Aichi; Shunji Yamamoto, Shinshiro; Osamu Okada, Toyokawa, all of Japan

[73] Assignee: Minolta Camera Kabushiki Kaisha, Azuchi, Japan

[21] Appl. No.: 813,183

[22] Filed: Jul. 6, 1977

[30] Foreign Application Priority Data

Jul. 8, 1976 [JP] Japan ..... 51-81728

[51] Int. Cl.[2] ..... G03G 15/00

[52] U.S. Cl. ..... 355/14; 355/8; 355/10; 355/60

[58] Field of Search ..... 355/14, 8, 55, 60–63

[56] References Cited

U.S. PATENT DOCUMENTS

| | | | |
|---|---|---|---|
| 3,876,300 | 4/1975 | Washio et al. | 355/14 X |
| 4,012,138 | 3/1977 | Washio et al. | 355/14 X |
| 4,017,175 | 4/1977 | Washio et al. | 355/14 |
| 4,025,178 | 5/1977 | Yokozawa et al. | 355/14 X |

*Primary Examiner*—R. L. Moses

[57] ABSTRACT

A transfer type electrophotographic copying apparatus of scanning system compact in size and efficient in copying operation and maintenance which is equipped with an improved copying sequence control arrangement through which an exposure lamp for an original to be copied, corona charger for a photoreceptor and also copy paper feeding device are adapted to be simultaneously turned ON by signal from one detecting means, while the number of detecting switches for operating various components of the copying apparatus in association with the copying operation is reduced to minimum by disposing such components at predetermined distances from each other, with the circuit for the control being also extremely simplified.

9 Claims, 22 Drawing Figures

ELECTROPHOTOGRAPHIC COPYING APPARATUS

Figure 1:
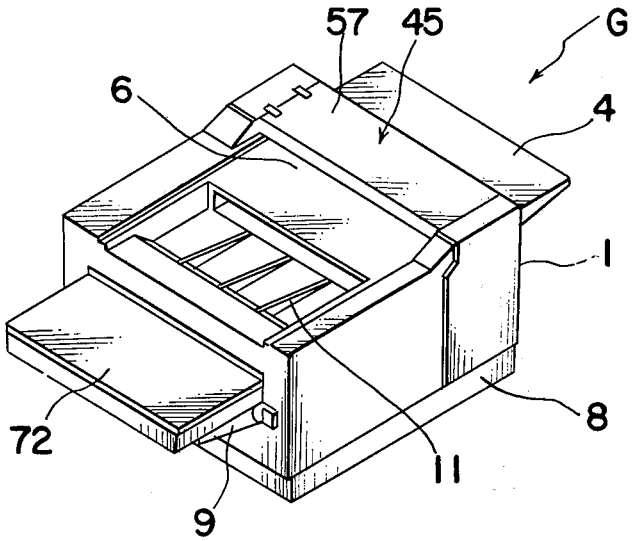

The present invention relates to an electrophotographic copying apparatus and more particularly, to a copying sequence control arrangement in an image transfer type electrophotographic copying apparatus of scanning system.

Commonly, in an image transfer type electrophotographic copying apparatus of scanning system, the original to be copied is sequentially scanned for projecting its image onto a photoreceptor surface moving at a predetermined speed so as to form thereon an electrostatic latent image of the original which is subsequently developed in a known manner for obtaining copied images. Accordingly, there have conventionally been proposed various function or sequence control arrangements for use in such electrophotographic copying apparatus to achieve synchronization in driving between the original being scanned and the photoreceptor, or synchronization between copy paper and other components of the copying apparatus with respect to the movements of the photoreceptor and the scanning of the original.

The most common type of such known sequence control arrangements is so constructed, for example, that copy paper transportation starting signal or copy paper feeding signal is first produced upon generation of copying operation starting signal generally by depression of a print switch, while various signals such as signals for scanning system movement initiation, energization of exposure lamp and corona charger, and the like are obtained through switch means emitting signals by detecting the copy paper being transported. Meanwhile, in a conventional transfer type electrophotographic copying apparatus equipped with a photoreceptor drum having a junction or seam in its photoreceptor, a still more complicated control mechanism is required from the necessity for achieving synchronization between the original scanning system, photoreceptor and copy paper, and thus means, for example, for controlling a large number of switches by cam member actuated through the copying operation or by similar means has inevitably been employed.

The conventional copying sequence control arrangements as described above, however, have serious disadvantages in that the controlling of various parts of the copying apparatus through control of many switch groups, for example, by copy paper, scanning system, cam members or the like tends to result in deviation in the synchronization due to functioning error of each switch, with simultaneous complication of circuit construction and each part of the apparatus, thus further requiring extremely complex circuits and devices in providing various mechanisms for detecting abnormal conditions of the copying apparatus such as copy paper jamming. Accordingly, the number of the switches for attaining synchronization between the image of the original being scanned and copy paper or synchronization thereof with respect to other machine components should preferably be as small as possible for simplification of the control circuit and the copying apparatus itself.

Furthermore, in the conventional transfer type electrophotographic copying apparatus of scanning system in general, the distance between the copy paper feeding section from which the copy paper is supplied and a transfer station whereat the image is transferred onto the copy paper tends to be comparatively long, and it has been so arranged that the copy paper which is transported along the copy paper transportation passage in advance is adapted to be once stopped for standing-by on the way for synchronization of the copy paper and the original to be copied. The arrangement as described above, however, requires means for stopping the copy paper, means for re-starting the copy paper after the standing-by, etc., thus extremely complicated construction being undesirably involved.

Additionally, the known copying apparatus of the above described type is mainly divided into two types, i.e., the toner powder image transfer type wherein the latent image formed on the photoreceptor is transferred onto the copy paper after having been developed into a visible toner powder image and the electrostatic latent image transfer type wherein the latent image formed on the photoreceptor is directly transferred onto the copy paper for subsequent developing into a visible image. Both of the above described two types of the copying apparatus, however, have disadvantages as described hereinbelow, since optical system thereof for image formation is located at the upper portion of an apparatus housing, while transportation passage for the copy paper is disposed at the lower portion of the apparatus housing.

Such disadvantages are that:

(i) The optical system disposed at the upper portion of the apparatus housing occupies a considerably large space thereat, thus being a bottleneck in reduction of size of the copying apparatus, and if the upper portion of the apparatus housing is hingedly supported for lifting at servicing and maintenance, for example, replacement of the photoreceptor drum, the hingedly supported upper portion having heavy components of the optical system such as reflecting mirrors, image forming lenses and the like mounted thereon must be made extremely strong especially at the hinged portion, while the optical system itself is likely to have looseness during use.

(ii) By the disposition of the copy paper transportation passage at the lower portion of the apparatus housing, maintenance work for such a transportation passage tends to be difficult and troublesome, especially making it necessary to reach for the passage in a lateral direction in the case of removal of jammed copy paper. Furthermore, in cases where copy paper feeding rollers are arranged to contact the surface of the copy paper (image forming surface) during copy paper feeding, copied images tend to be deteriorated due to tribo-electrical charging.

In order to overcome the disadvantages as described above, there have conventionally been proposed transfer type electrophotographic copying apparatuses of scanning system, for example, in U.S. Pat. No. 3,770,345 in which the photoreceptor drum is provided at the middle portion of the apparatus housing, with the copy paper transportation passage of U-turn path being located at its upper portion, while part of the optical system for image formation is disposed at its lower portion for exposing the photoreceptor drum to light directed form approximately lower portion of the drum, or in U.S. Pat. No. 3,804,512 in which copying operation is controlled in such a manner that upon detection of the leading edge of the original by a photocell, original feeding rollers are once stopped, with subsequent rotation of the photoreceptor drum for developing signal at a predetermined position to initiate transportation of the copy paper. The known copying apparatuses of the above described type, however, are rather complicated in constructions, and especially in terms of the copying sequence control arrangement, still have considerable room for improvement.

Accordingly, an essential object of the present invention is to provide a transfer type electrophotographic copying apparatus of scanning system which is equipped with an improved copying sequence control arrangement.

Another important object of the present invention is to provide an electrophotographic copying apparatus of the above described type in which the copying sequence control arrangement is simplified in structure so as to provide rapid copying operation.

A further object of the present invention is to provide a copying sequence control arrangement most suitable for a compact transfer type electrophotographic copying apparatus of scanning system.

A still further object of the present invention is to provide a compact transfer type electrophotographic copying apparatus of scanning system which is capable of rapid and high speed copying operation.

Another object of the present invention is to provide an electrophotographic copying apparatus of the above described type which is accurate and stable in functioning and can be manufactured at low cost.

In accomplishing these and other objects, according to one embodiment of the present invention, the transfer type electrophotographic copying apparatus is equipped with a copying sequence control arrangement through which an exposure lamp for an original to be copied, corona charger and also copy paper feeding device are adapted to be simultaneously turned ON by signal from one detecting means, while the number of detecting switches for operating various components of the copying apparatus in association with the copying operation is reduced to minimum by disposing such components at predetermined distances, with the circuit for the control being also extremely simplified. Furthermore, in the copying apparatus of the invention, the photoreceptor drum is disposed at the middle stage of the apparatus housing, with the transportation passage for the copy paper being provided at its upper stage which is arranged to be raised upward for facilitation of maintenance such as removal of jammed copy paper, while the copy paper feeding roller is adapted to contact the reverse surface of copy paper sheet during copy paper feeding for preventing deterioration of copied images due to tribo-electrical charging. Moreover, by providing part of image forming optical system at the lower stage of the apparatus housing, such optical system is advantageously accommodated in a base portion of the housing which also serves for reinforcement of the apparatus housing, and thus not only the optical system is prevented from becoming loose during use, but the size of the copying apparatus itself being appreciably reduced, with substantial elimination of disadvantages inherent in the conventional copying apparatus of the kind.

Figure 2:
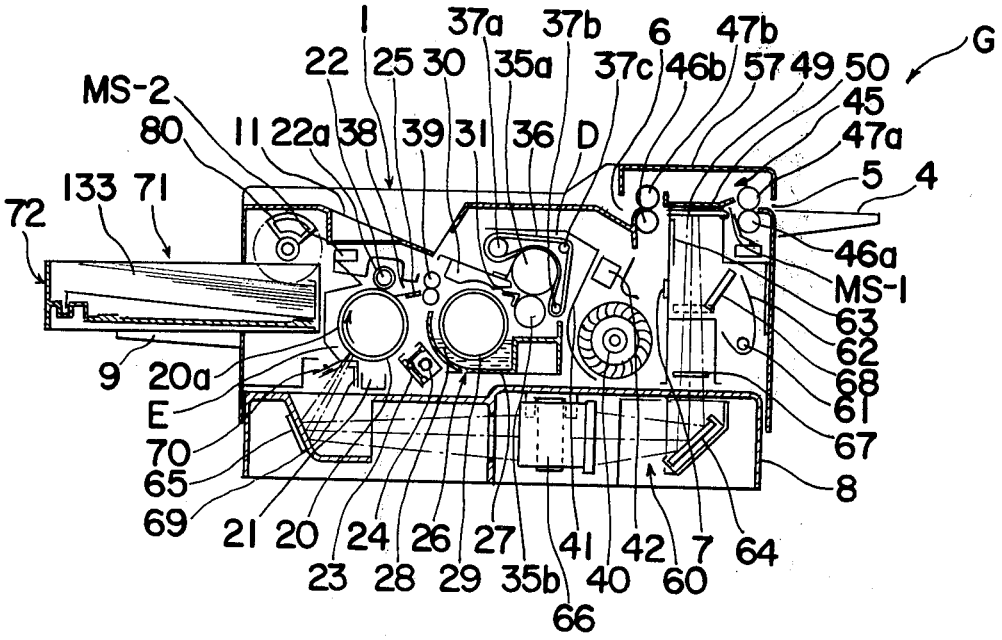
Figure 3:
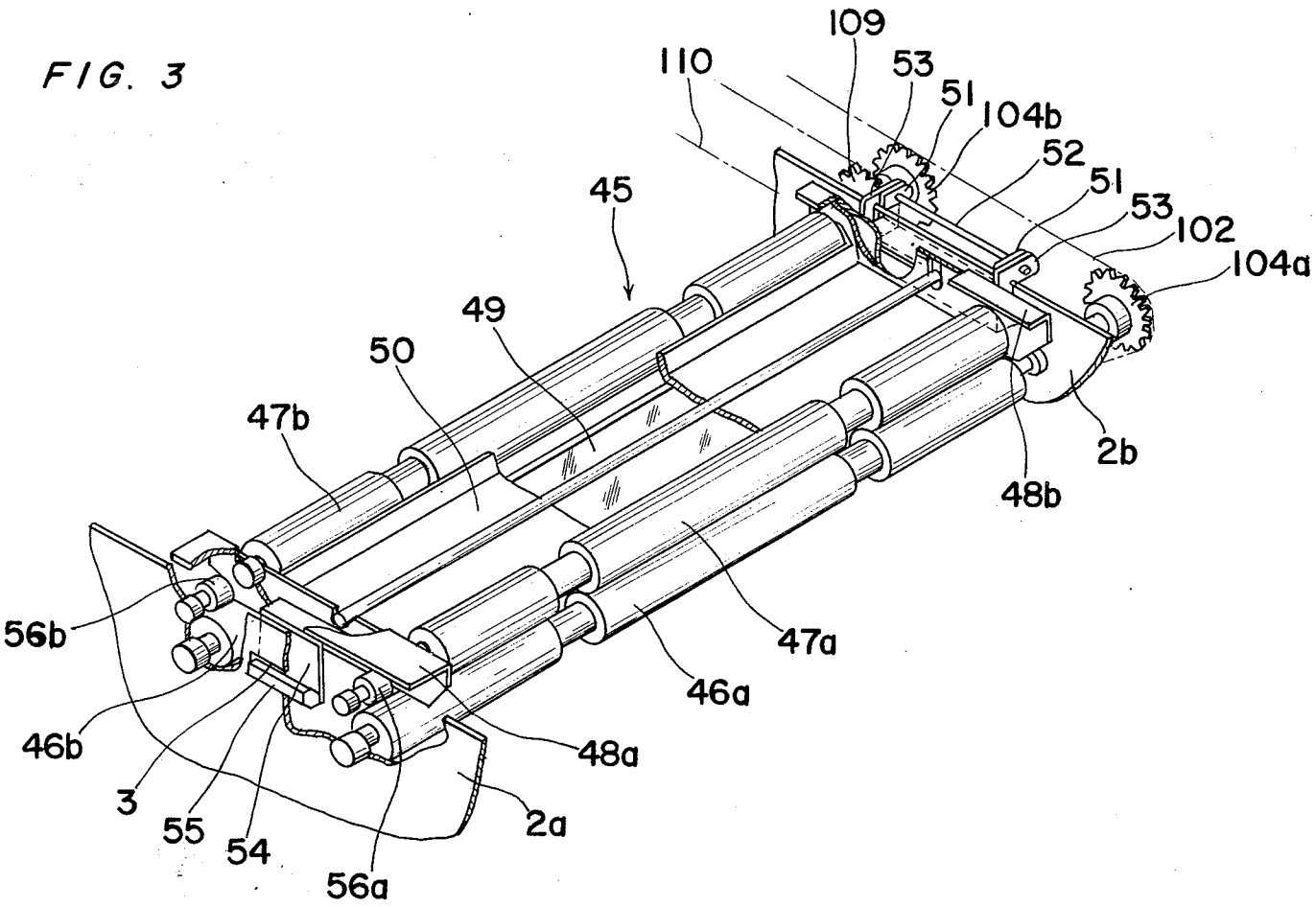
Figure 4:
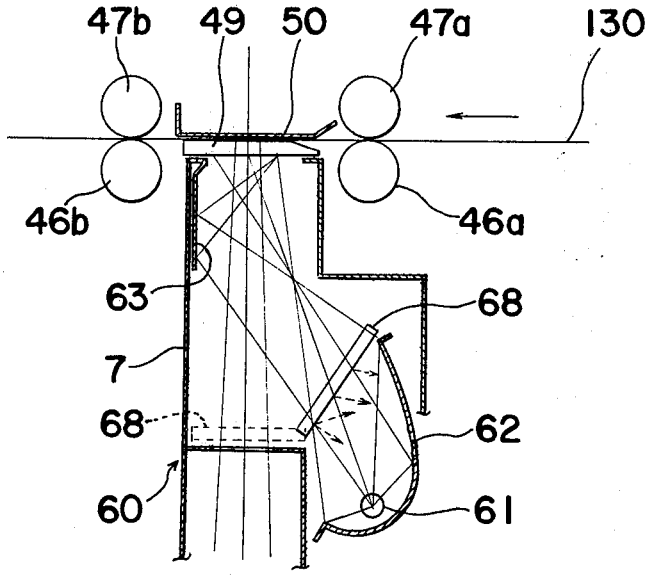
Figure 4:
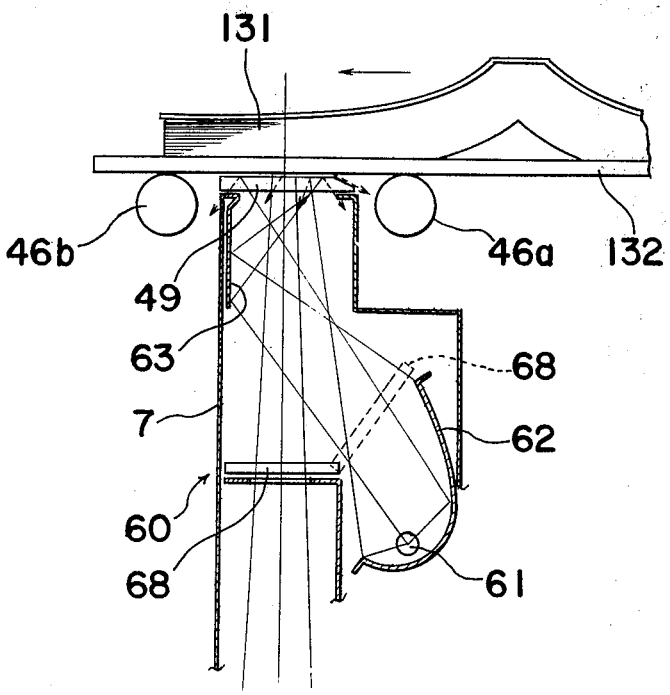
Figure 5:
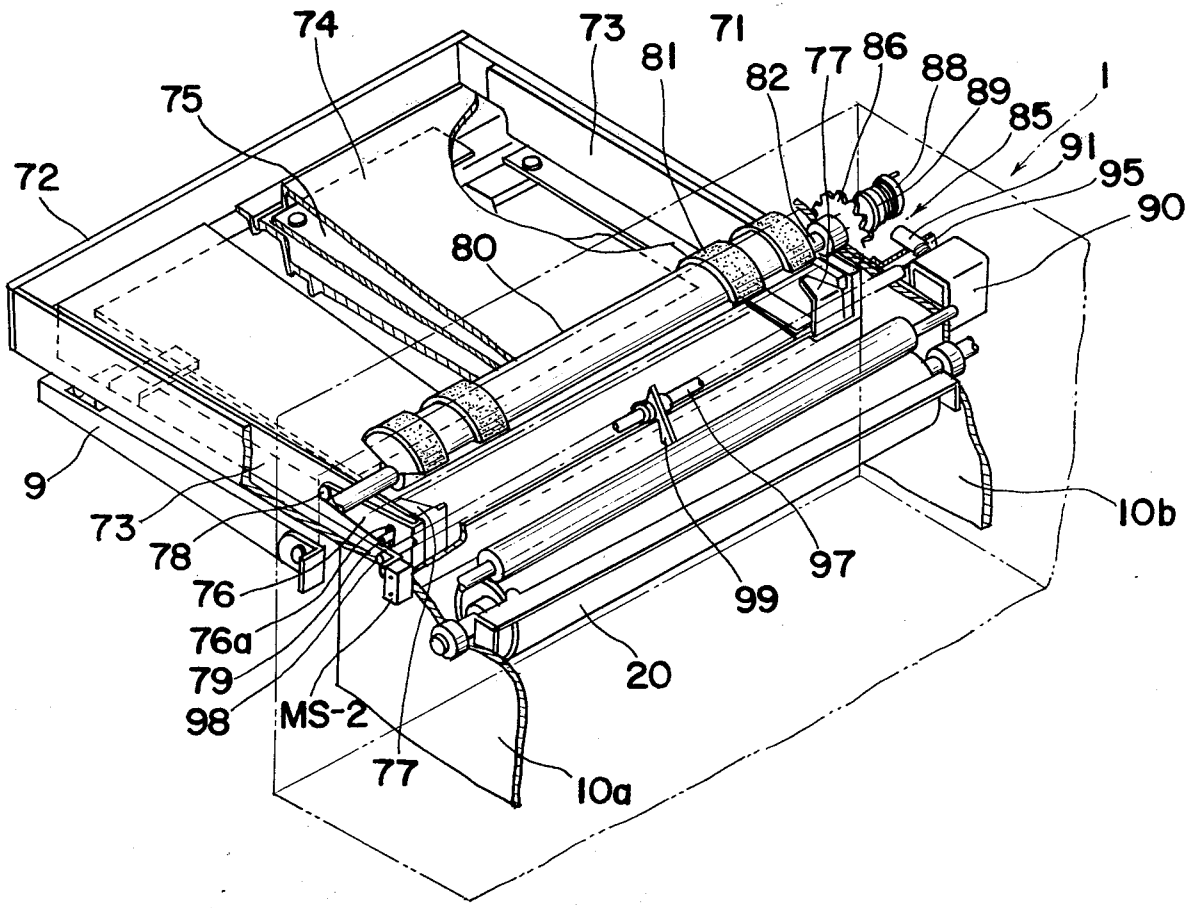
Figure 6:
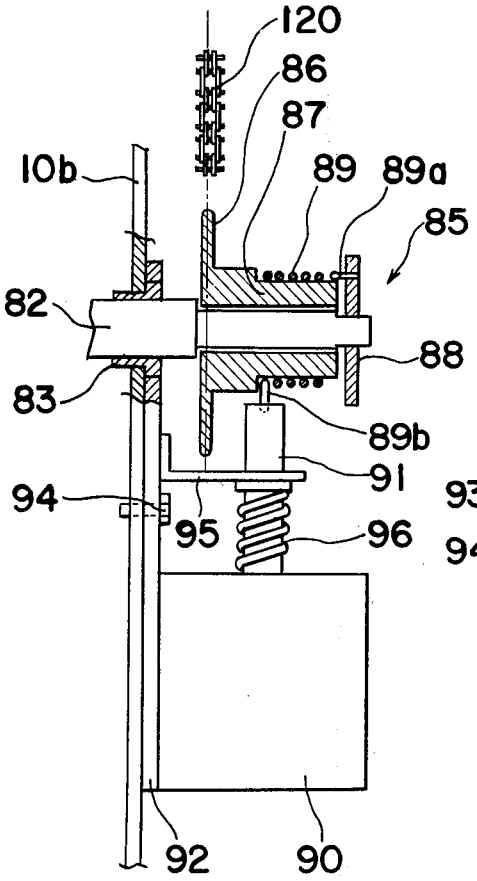
Figure 6:
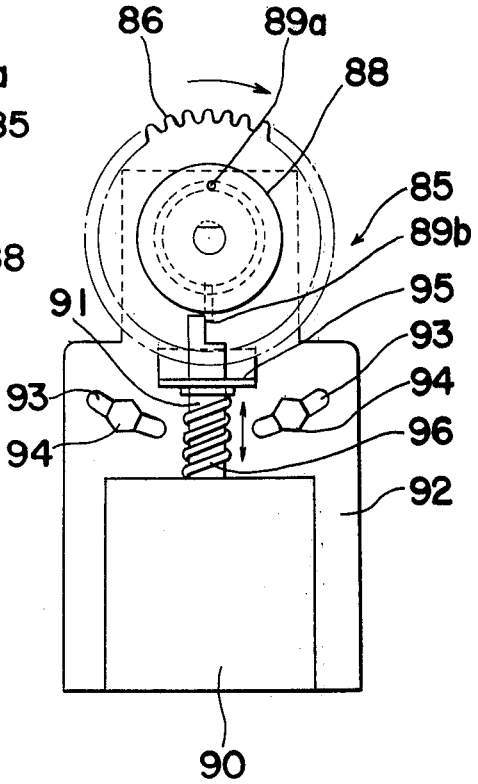
Figure 7:
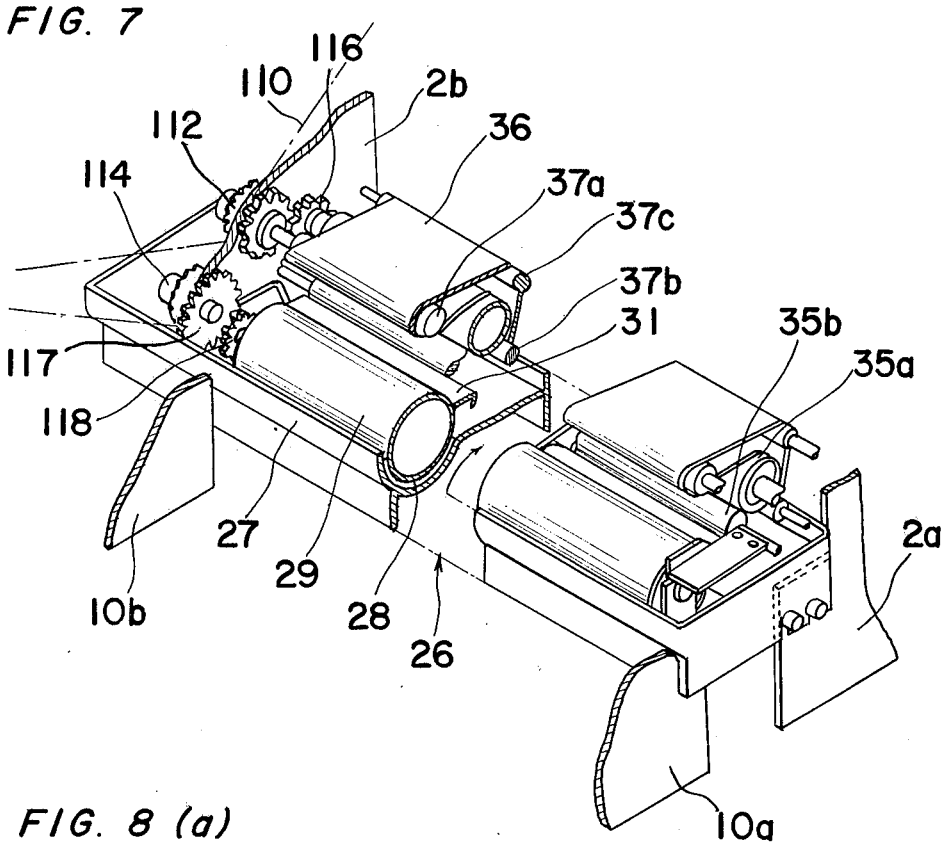
Figure 8:
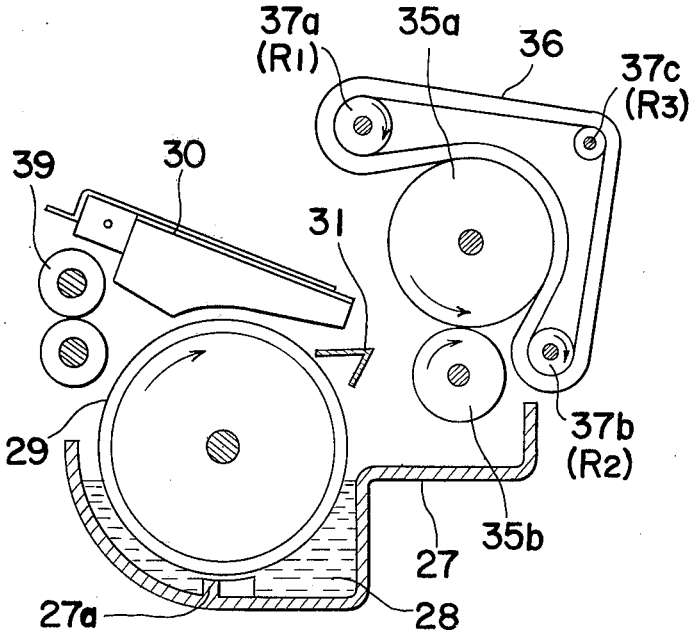
Figure 8:
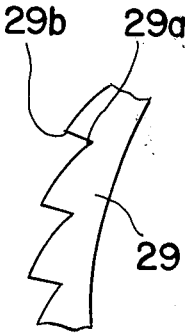
Figure 9:
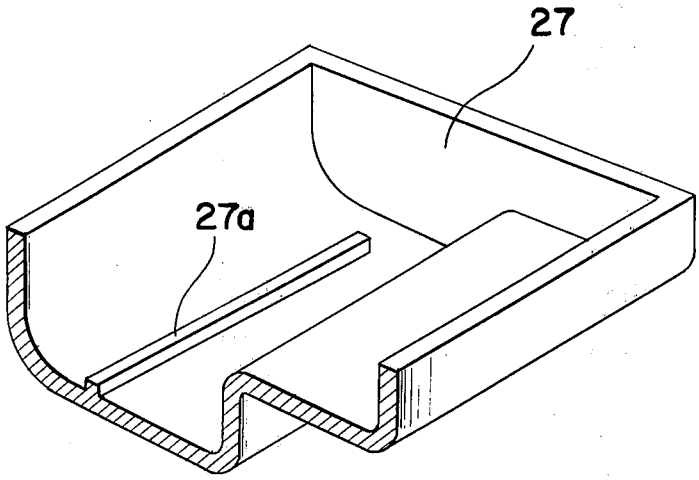
Figure 10:
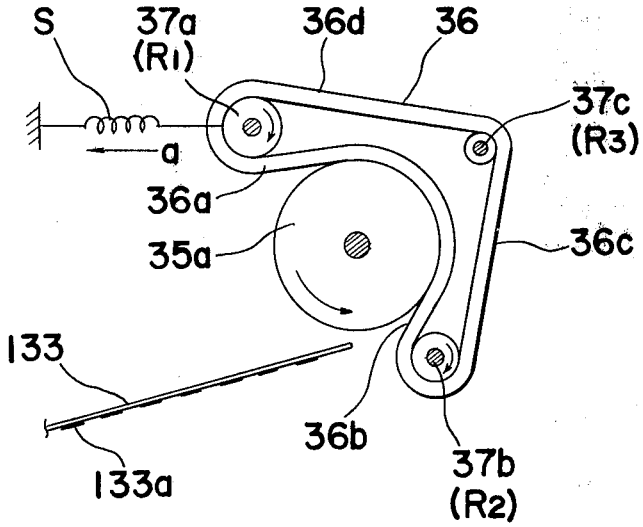
Figure 11:
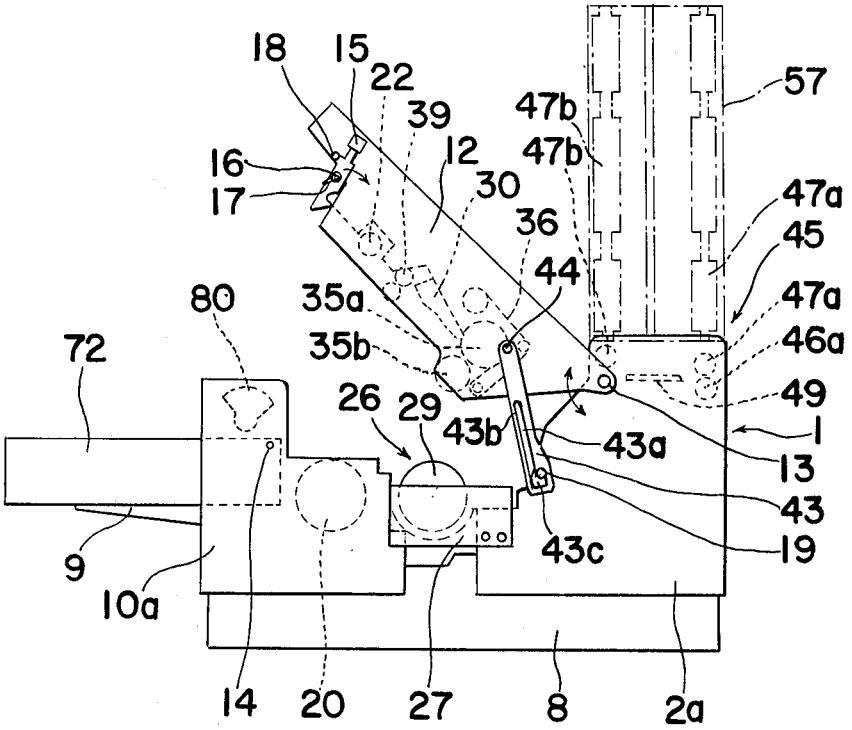
Figure 12:
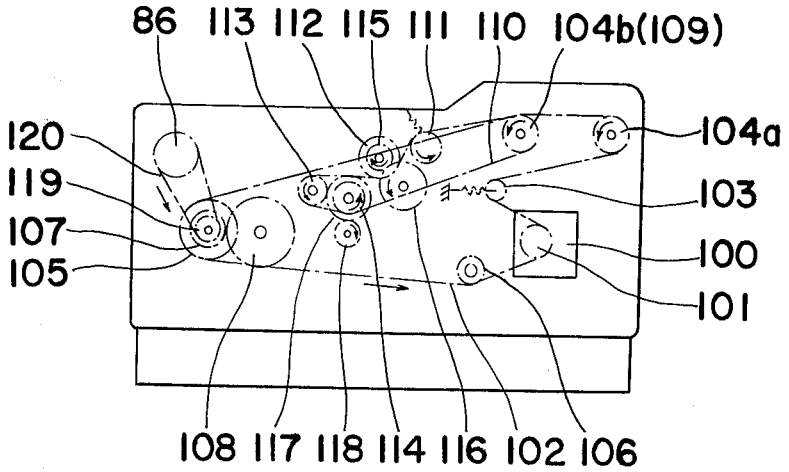
Figure 13:
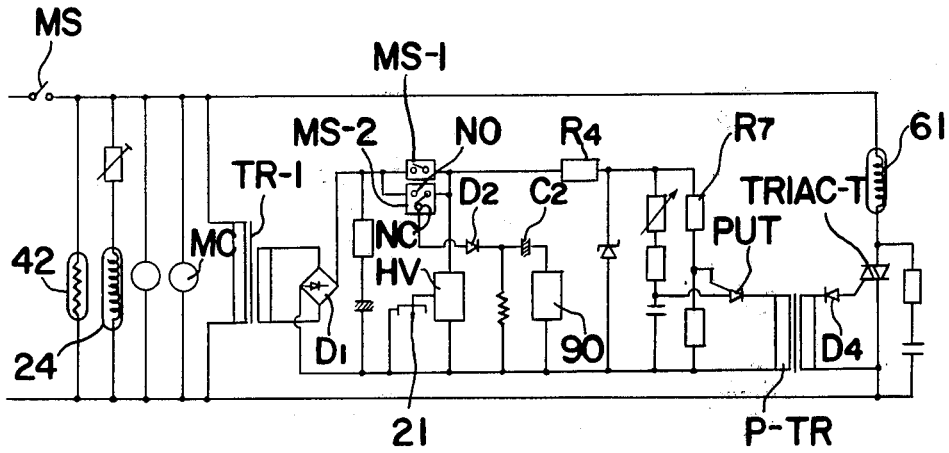
Figure 14:
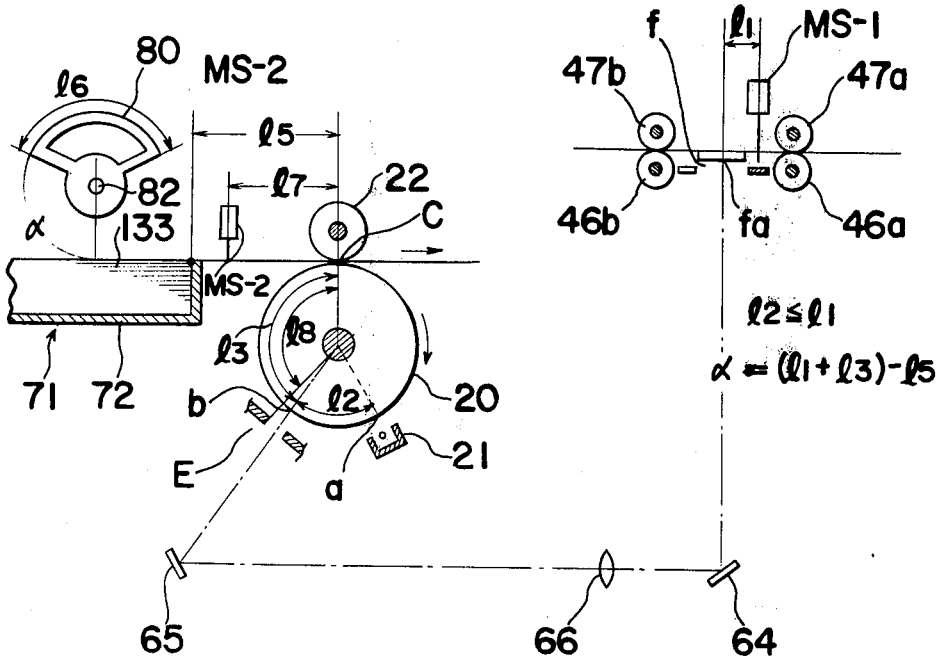
Figure 15:
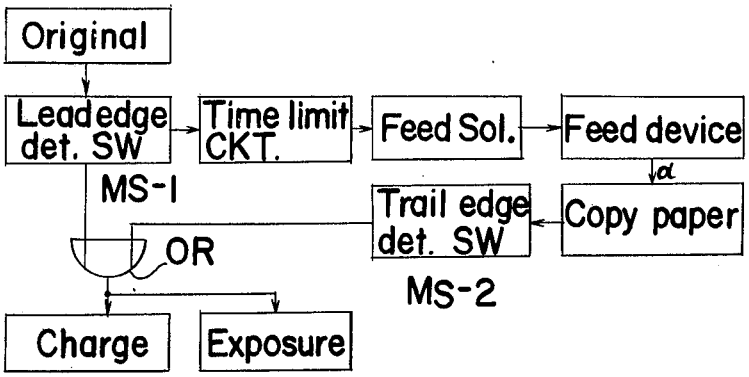
Figure 16:
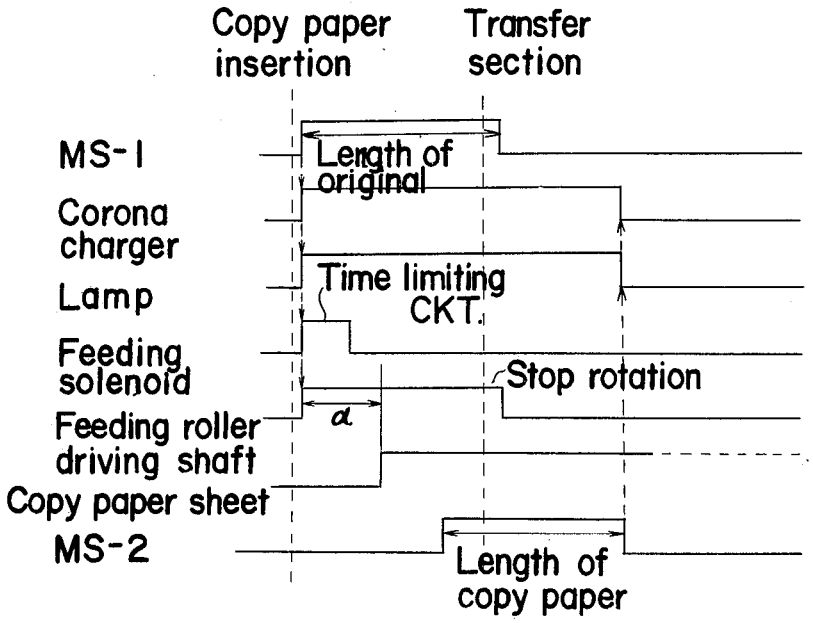
Figure 17:
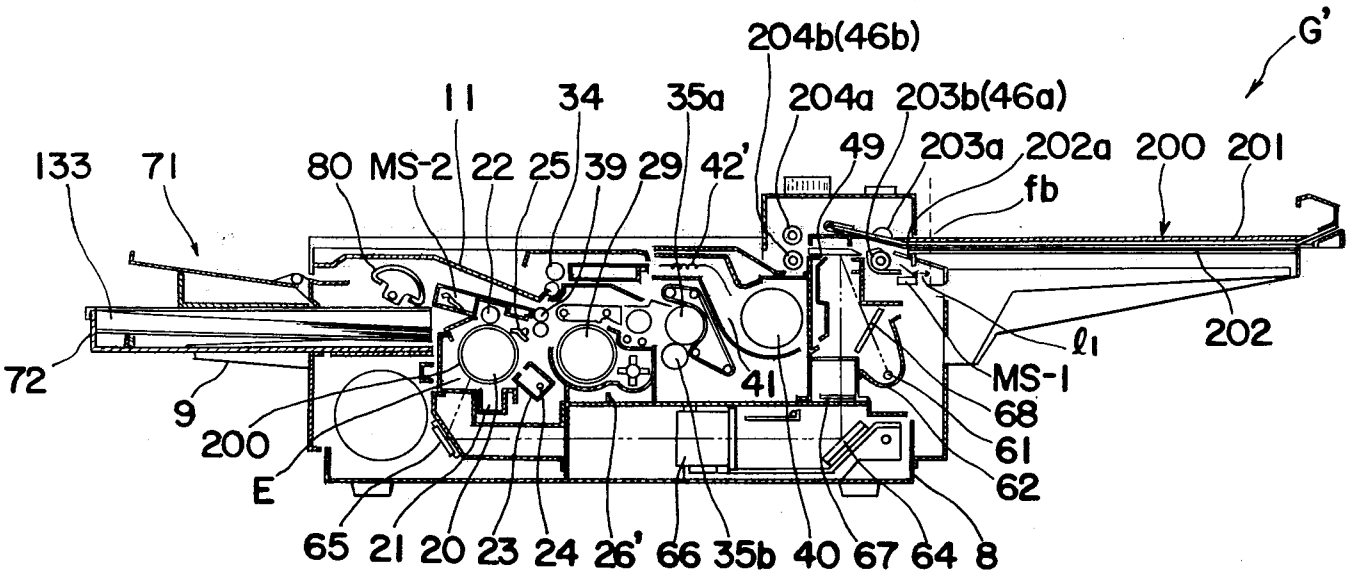
Figure 18:
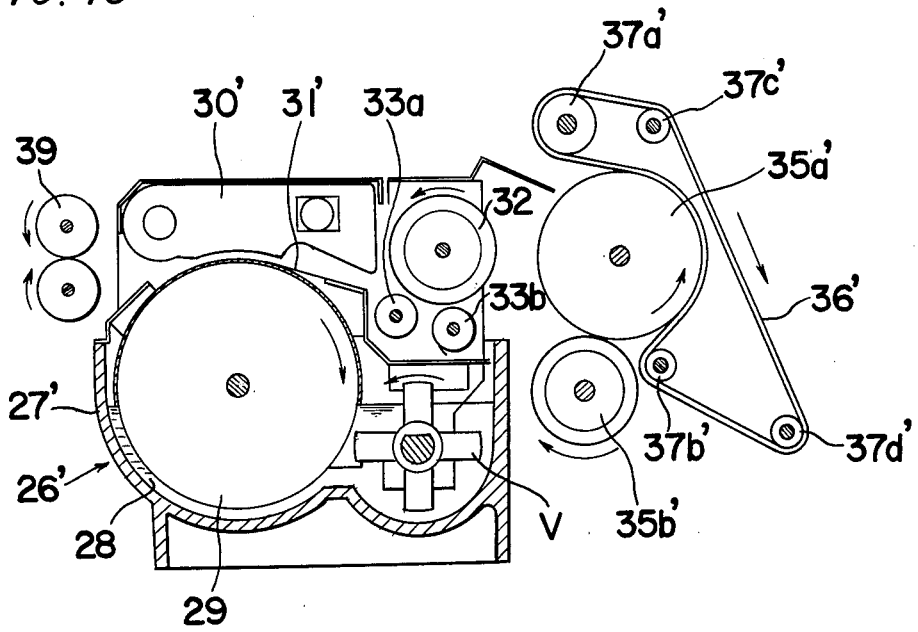
Figure 19:
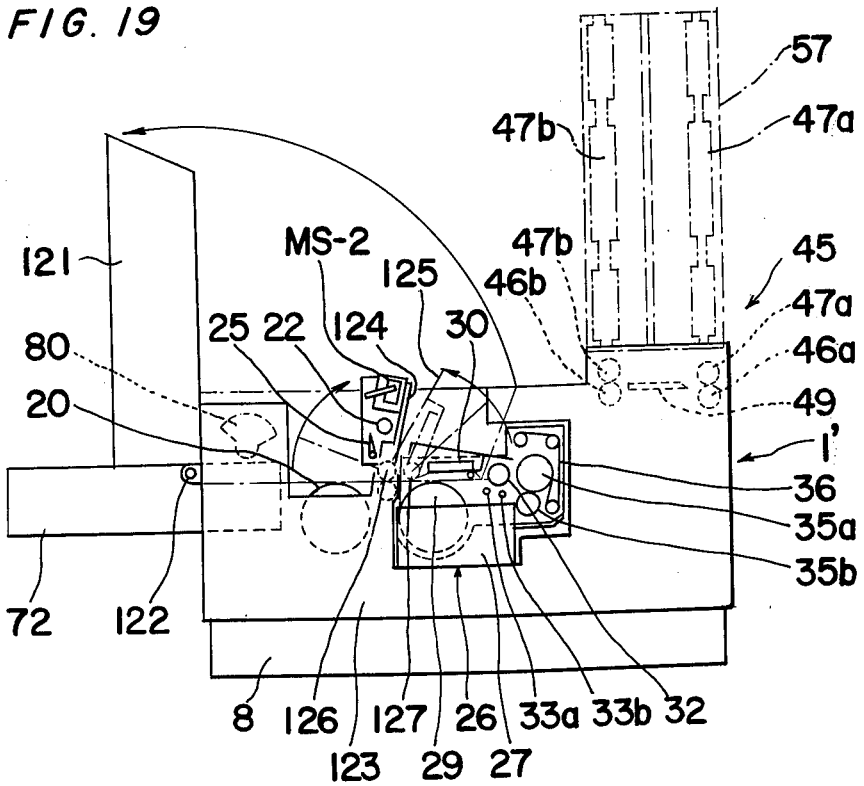

These and other objects and features of the present invention will become apparent from the following description taken in conjunction with the preferred embodiment thereof with reference to the accompanying drawings in which;

FIG. 1 is a perspective view of a transfer type electrophotographic copying apparatus according to one preferred embodiment of the present invention, FIG. 2 is a schematic side sectional view of the copying apparatus of FIG. 1, FIG. 3 is a perspective view showing, on an enlarged scale, construction of an original transporting unit employed in the copying apparatus of FIG. 1, FIGS. 4(a) and 4(b) are side sectional views showing, on an enlarged scale, construction of an image forming optical system employed in the copying apparatus of FIG. 1, FIG. 5 is a perspective view showing, on an enlarged scale, construction of a copy paper feeding device employed in the copying apparatus of FIG. 1, FIG. 6(a) is a side elevational view partly in section showing, on an enlarged scale, construction of clutch means employed in the copying apparatus of FIG. 1, FIG. 6(b) is a front view of the clutch means of FIG. 6(a), FIG. 7 is a perspective view showing, on an enlarged scale, construction of a developing unit employed in the copying apparatus of FIG. 1, FIG. 8(a) is a side sectional view showing a modification of the developing unit of FIG. 7 on a still enlarged scale, FIG. 8(b) is a fragmentary view showing, on a further enlarged scale, construction of a surface of a developing roller employed in the developing unit of FIG. 8(a), FIG. 9 is a perspective view of a developing tank employed in the developing unit of FIG. 8(a), FIG. 10 is a side elevational view explanatory of a copy paper transporting arrangement employed for the developing unit of FIG. 8(a), FIG. 11 is a similar view to FIG. 2, but particularly shows an arrangement for dividing the copying apparatus into an upper portion and lower portion, with the upper portion raised for opening, FIG. 12 is a similar view to FIG. 2, but particularly shows driving system thereof, FIG. 13 is an electrical circuit diagram showing a control circuit employed in the copying apparatus of FIG. 2, FIG. 14 is a schematic diagram explanatory of positional relation of microswitches, copy paper feeding roller, etc., employed in the copying apparatus of FIG. 2, FIG. 15 is a block diagram showing arrangement of the control circuit of FIG. 13, FIG. 16 is a time chart explanatory of the operation of the control circuit of FIG. 13, FIG. 17 is a similar view to FIG. 2, but particularly shows a modification thereof, FIG. 18 is a similar view to FIG. 8(a), but particularly shows a modification thereof employed in the modified copying apparatus of FIG. 17, and FIG. 19 is a similar view to FIG. 11, but particularly shows a modification thereof employed in the modified copying apparatus of FIG. 17.

Before the description of the present invention proceeds, it is to be noted that like parts are designated by like reference numerals throughout several views of the accompanying drawings.

Referring now to the drawings, there is shown in FIGS. 1 and 2 a transfer type electrophotographic copying apparatus G according to one preferred embodiment of the present invention. In FIG. 2, the copying apparatus G generally includes an apparatus housing 1 of rectangular box-like configuration defined by walls, and a photosensitive member or photoreceptor drum 20 of known construction having a photoconductive photoreceptor surface 20*a* provided on the outer periphery thereof and rotatably disposed at approximately the central portion of the housing 1 for rotation in the direction of the arrow to cause the photoreceptor surface 20*a* sequentially pass various processing stations disposed therearound for image formation, such as a charging station with a corona charger 21, an exposure station E, a transfer station having a transfer roller 22, a developing station having a developing unit 26, a charge erasing station 23 provided with an eraser lamp 24, etc. Further inlcuded in the copying apparatus G are a transportation unit 45 for an original (not shown) to be copied, an optical system 60 which further includes a light shielding case 7 extending upwardly from a base block 8 to form an approximately L-shaped light passage between the original transportation unit 45 and the exposure station E, a transfer material or copy paper feeding device 71, and a copy paper transportation passage leading from the copy paper feeding device 71 to an upper surface of the apparatus housing 1 through the upper portions of the photoreceptor drum 20 and developing unit 26 via squeezing rollers 35*a* and 35*b* and developing solution absorbing belt 36.

Referring also to FIG. 3, the original transportation unit 45 arranged to be capable of selectively transporting a thin original in the form of sheet and thick original such as a book includes original transportation rollers 46*a* and 46*b* disposed in parallel and in spaced relation to each other to be rotatably supported by frames 2*a* and 2*b* through bearings (not shown), and corresponding transportation rollers 47*a* and 47*b* respectively contacting the rollers 46*a* and 46*b* under pressure for rotation following the rotation of the rollers 46*a* and 46*b* and supported by side plates 48*a* and 48*b* of a cover plate 57 for the housing 1 through bearings (not shown). In the space between the rollers 46*a* and 47*a*, and 46*b* and 47*b*, a transparent plate 49, for example, of glass material for placing thereon the original to be copied is supported by the frames 2*a* and 2*b*, while a guide plate 50 secured at opposite ends thereof to the side plates 48*a* and 48*b* is disposed adjacent to and above the transparent plate 49. The side plate 48*b* is connected to a pair of spaced brackets 51 secured to the frame 2*b* through a corresponding pair of L-shaped lever members 53 each fixed to the side plate 48*b* at its one end and pivotally connected at its other end to the brackets 51 through a shaft 52. Meanwhile, the other side plate 48*a* has a spring plate 54 of L-shaped cross section fixed in a position adjacent to one edge thereof to the side plate 48*a*, while a locking member, for example, a locking rod 55 having hexagonal cross section is secured adjacent to the other edge of the same side plate 48*a* for being fitted into a lock opening 3 of corresponding shape formed in the frame 2*a* by the resilience of the spring plate 54.

More specifically, in the above arrangement, the transportation rollers 47*a* and 47*b* are upwardly movable about the shaft 52 together with the cover plate 57, and when the cover plate 57 is rotated downward for closing, with the locking member 55 engaged with the lock opening 3, the thin or sheet original 130 (FIG. 4(*a*)) mounted on a table 4 is inserted, through an inlet opening 5 formed in the side wall of the apparatus housing 1 in a position adjacent to the platform 4, into the original transportation unit 45 and transported through the space between the transparent plate 49 and the guide plate 50 by the rollers 46*a* and 47*a*, and 46*b* and 47*b* to be subsequently discharged out of an outlet opening 6 formed at the upper portion of the housing 1.

On the other hand, for copying the thick originals, for example, a book original 131 (FIG. 4(b)), the cover plate 57 is rotated upward together with the rollers 47*a* and 47*b*, with the locking by the lock member 55 being released by depressing the member 55 inward toward the frame 2*a*, and a thick original or book carrier 132 (FIG. 4(b)) of transparent material on which the book original 131 is mounted is transported while being held at opposite edges thereof between the rollers 46*a* and 46*b*, and spaced rollers 56*a* and 56*b* (FIG. 3) rotatably supported by the side plates 2*a* and 2*b*.

The original transportation unit 45 has a microswitch MS-1 disposed therein for detecting the leading edge of the original 130, with the actuator of the microswitch MS-1 extending immediately after the rollers 46*a* and 47*a* as shown in FIG. 2.

Referring back to FIG. 2, the optical system 60 for the image formation mainly includes, in its L-shaped light passage composed of the light shielding case 7 and base block 8, a light source, for example, an exposure lamp or illuminating lamp 61 for illuminating the original on the transparent plate 49, reflecting mirrors 64 and 65 suitably inclined to direct the light rays from the original toward the photoreceptor surface 20*a*, and an image forming lens assembly 66 disposed between the mirrors 64 and 65. The illuminating lamp 61 which is accommodated in a reflecting shade 62 having elliptical surface, and a flat auxiliary reflecting mirror 63 are disposed below and adjacent to the copy paper transportation unit 45 in the light shielding case 7, while the reflecting mirrors 64 and 65 and the image forming mirror assembly 66 are housed in the base block 8 which functions both as a dark box and a base for reinforcing the copying apparatus itself. Additionally, at the junction between the light shielding case 7 and the base block 8, a dust-proof plate 67, for example, of glass material is disposed, while, in the light shielding case at a position adjacent to the reflecting shade 62 for the illuminating lamp 61, a correction plate 68, for example, also of glass material is pivotally disposed, which correction plate 68 is arranged to be selectively positioned in front of the reflecting shade 62 as shown in FIG. 4(a) when the thin original 130 in the form of a sheet is employed, and in the path of light rays after reflection thereof on the surface of the original as shown in FIG. 4(b) during use of the thick original 131 in the form of books. The correction plate 68 is intended to correct the difference in the light paths by the changeover between the sheet original 130 and the book original 131, i.e., increase of the light path in the book original 131 by the thickness of the book carrier 132 (FIG. 4(b)) as compared with that in the sheet original 130, through utilization of refractive index of light rays, and also to correct in intensity of illumination at the surface of the original by the illuminating lamp 61.

It should be noted here that the correction plate 68 of glass material may be so arranged as to function as a filter for providing isochromatic characteristics through variation of permeable wavelengths depending on the photosensitivity of the photoreceptor layer 20*a* of the photoreceptor drum 20, and also to function as a heat absorbing glass. In the above case, the dust-proof plate 67 may be adapted to simultaneously have the functions as the filter and the heat absorbing glass.

The light rays from the illuminating lamp 61 are reflected by the surface of the original toward the first reflecting mirror 64 for being further directed, through the image forming lens assembly 66, toward the second reflecting mirror 65 to be reflected thereby toward the exposure station E for exposing the photoreceptor surface 20*a* at the lower portion of the photoreceptor 20. In the passage for the light rays immediately before the exposure station E, there is formed a known slit by an adjusting plate 69 and a diaphragm plate 70 which are adjustable for obtaining uniform exposure of predetermined amount.

Referring also to FIGS. 5 to 6(b), the copy paper feeding device 71 generally includes a tray or cassette 72 for holding a supply of cut sheet transfer material or copy paper sheet, feeding roller 80, and clutch means 85. The paper tray 72 made, for example, of synthetic resin material is mounted on a tray table 9 laterally extending from one side of the apparatus housing 1 and has side walls 73 secured to opposite sides thereof with set screws, while its bottom plate 74 is disposed on the table 9 in an inclined state with an outer edge thereof raised to a certain degree by a spring plate 75. Copy paper sheets 133 cut into predetermined size are positioned, at opposite edge thereof by the side walls 73, to be placed in a predetermined position on the bottom plate 74.

The copy paper sheet 133 is composed of a base of paper material provided with a dielectric layer formed on its one surface through application of insulating material having electrical resistance of approximately $10^{14}$ to $10^{18}$ Ωcm, and also provided with an electrically conductive layer formed on its other surface through application of conductive material having electrical resistance of approximately $10^5$ to $10^9$ Ωcm. For copying operation, the copy paper sheets 133 are accommodated in a stack in the tray 72 with the dielectric layers thereof directed downward, on which dielectric layers, copied imaged are to be formed.

To one end of each of the side walls 73 located in the apparatus housing 1, there is pivotally connected, by a pin 78, a lever 76 having a claw 77 at its forward end. The claws 77 are adapted to contact the forward edge of the stack of the copy paper sheets 133 at opposite sides of the latter under light pressure, while the height of the claws 77 is restricted by pins 79 provided on the side plates 73 and extending through elongated openings 76*a* formed in the levers 76.

The copy paper feeding roller 80 provided with axially spaced layers 81 of frictional elastic material has a cross section in the shape of a sector of one-fourth to half a circle, and is journalled, at its shafts 82, by bearings 83 (FIG. 6(a)) in frames 10*a* and 10*b*. The feeding roller 80 is adapted to start rotation from a predetermined position by clutch means 85 mentioned below so as to contact the reverse surface, i.e., the electrically conductive layer of the copy paper sheet 133 for feeding the sheets 133 one sheet by one sheet. For the frictional elastic layers 81 as described above, it is preferable to select a material that is free from electrical charging as far as possible when subjected to frictional contact with the copy paper sheet 133.

The clutch means 85 includes a sprocket 86 rotatably mounted on one end of the shafts 82 of the copy paper feeding roller 80 and a retaining plate 88 secured to the extreme end of the same shaft 82, while a coil spring 89 is disposed around a boss portion 87 of the sprocket 86, with one end 89*a* of the spring 89 being suitably fixed to the retaining plate 88 and the other end 89*b* thereof being adapted to engage a plunger 91 of a solenoid 90. The solenoid 90 electrically connected to the microswitch MS-1 (FIG. 2) is fixed to a fixing plate 92 which is secured to the frame 10*b*, for example, by securing screws 94 extending through a pair of arcuate openings 93 formed in the plate 92, and is adapted, upon loosening of the screws 94, to be adjustable in its position about the shaft 82 of the feeding roller 80 within the limit of the arcuate openings 93. The plunger 91 of the solenoid 90 is normally urged upward in FIGS. 6(a) and 6(b) by a return spring 96 disposed therearound and retained by a plate 95 suitably secured to the fixing plate 92, while the sprocket 86 is driven for rotation through a chain 120 or the like by a driving system described hereinbelow.

The sprocket 86 rotates upon transmission of rotational force through the chain 120, and when the end 89*b* of the spring 89 is in engagement with the corresponding end of the plunger 91, the spring 89 urges the sprocket 86 in the returning direction, thus only the sprocket 86 slipping for rotation. When the solenoid 90 is energized, with the plunger 91 being retracted to be disengaged from the end 89*b* of the spring 89, the spring 89 is tightly wound onto the boss portion 87 of the sprocket 86, and thus the rotation of the sprocket 86 is transmitted to the shaft 82 of the feeding roller 80 through the spring 89 and retaining plate 88 for rotating the roller 80.

After idle rotation of the feeding roller 80 to a certain extent, the frictional elastic material 81 of the roller 80 contacts the copy paper sheet 133 for forcibly feeding the sheet 133. It is to be noted here that since the solenoid is energized only momentarily, the plunger 91 returns to the original position during one rotation of the feeding roller 80, with the end 89*b* of the spring 89 being again engaged with the corresponding end of the plunger 91 to rotate only the sprocket 86 in the slipping state, and the feeding roller 80 stops at the original starting position after one rotation. In this case, timing for the copy paper feeding may be adjusted by altering the starting position of the roller 80. Such an adjustment is readily effected by merely adjusting the point of engagement between the plunger 91 and the spring 89 through variation of the fixing angle of the fixing plate 92 for the solenoid 90 in the manner as described earlier.

On the frame 10*a*, there is also mounted a microswitch MS-2 for detecting the copy paper sheet 133. The actuator (not shown) of the microswitch MS-2 is engageable with a cam 98 (FIG. 5) fixed at a corresponding end of a shaft 97 which is journalled for rotation in the frames 10*a* and 10*b* and provided with a contact piece 99 fixed at its central portion. The contact piece 99 is located immediately before the stack of the copy paper sheet 133 (FIG. 2) accommodated in the tray 72, and the leading edge of the copy paper sheet 133 contacts the contact piece 99, immediately after being forwarded in the earlier described manner, to rotate the cam 98 through the shaft 97 for actuating the microswitch MS-2.

It has been found in a series of experiments carried out by the present inventors that, in the copy paper feeding as described above, since the copy paper sheets 133 are housed in the tray 72 with the image forming surfaces or dielectric layers thereof directed downward, the copy paper feeding roller 80 never contacts the image forming surfaces of the copy paper sheets and consequently, copied images are free from any deterioration after development due to tribo-electrical charge by the contact thereof with the roller 80.

The transfer roller 22 (FIG. 2) having an electrically conductive elastic layer 22*a* formed on its outer periphery and rotatably provided adjacent to the upper portion of the photoreceptor drum 20 so as to rotate following the rotation of the drum 20 has the elastic layer 22*a* thereof electrically connected to a conductive layer (not shown) laminated below the photoreceptor layer 20*a* of the drum 20, while a copy paper separating claw 25, for example, of synthetic resinous material is disposed adjacent to and below the transfer roller 22 to confront the direction of rotation of the drum 2 and to lightly contact the photoreceptor surface 20*a* of the drum 20.

Referring also to FIG. 7, the developing unit 26 disposed at the right hand side of the photoreceptor drum 20 in FIG. 2 includes a developing roller 29 rotatably provided for clockwise rotation in a developing tank 27 which is filled with developing solution 28 containing toner particles therein. The developing roller 29 has spiral or straight shallow grooves (not shown) formed on its outer periphery, while a press plate or guide 30 is disposed above the developing roller 29 with a slight gap being provided therebetween. Adjacent to the developing roller 29 and below the press plate 31, there is disposed another separating claw 31, for example, of synthetic resin or metallic material so as to lightly contact the outer periphery of the developing roller 29 and to confront the direction of rotation of the roller 29. Subsequent to the claw 31, there are rotatably provided squeezing rollers 35*a* and 35*b* which are in contact with each other, while a developing solution absorbing belt 36 movably supported by rollers 37*a*, 37*b* and 37*c* contacts part of the outer periphery of the squeezing roller 35*a* under pressure.

In the developing unit 26 as described above, the developing roller 29 is adapted to be driven for rotation at high speed with respect to the transportation speed of the copy paper sheet 133, and while the electrostatic latent image of the original transferred onto the copy paper sheet 133 is developed, the copy paper sheet passes between the photoreceptor drum 20 and the transfer roller 22. It should be noted that the development as described above is effected, at one surface of the sheet 133, by the application of the developing solution drawn up through the shallow grooves (not shown) on the outer periphery of the developing roller 29, only onto the image forming surface of the copy paper sheet 133. In such one side developing, the copy paper sheet is less wet and requires no anti-permeability treatment at the back surface. The shallow grooves formed in the outer periphery of the developing roller 29 have function for stirring the developing solution 28 as well as drawing up the same solution. The copy paper sheet subjected to the development in the above described manner is further deprived of the residual developing solution 28 by the squeezing rollers 35*a* and 35*b*, and the absorbing belt 36, and turned around as it passes between the roller 35*a* and the belt 36 to be discharged onto a discharge tray 11, with the image formed surface thereof directed upward. It should also be noted here that since the squeezing roller 35*a* and the absorbing belt 36 simultaneously serves as a reversing means for the copy paper sheet 133, no separate reversing means is required to be installed, thus contributing much to reduction of size of the copying apparatus. Additionally, since the squeezing roller 35*b* disposed below the roller 35*a* directly contacts the image formed surface of toner particles, the same roller 35*b* is made of material such as metal and the like capable of preventing the so-called off-set effect. The upper roller 35*a* is normally formed, on its surface, with an elastic material such as rubber, taking the squeezing effect into consideration, but it may be formed with other material having a property to absorb liquids. In other words, the surface material for the squeezing roller 35*a* may be suitably selected according to the degree of drying of the copy paper sheet 133 or to the degree of soiling of the squeezing roller 35*b* by the developing solution 28.

As is clear from the foregoing description, the transportation passage 38 for the copy paper sheet 133 includes the photoreceptor drum 20, transfer roller 22, transportation rollers 39, developing roller 29 with the press plate 30, squeezing rollers 35*a* and 35*b* and absorbing belt 36.

Further disposed in the apparatus housing 1 in a position between the absorbing belt 36 and the original transportation unit 45 is an exhaust fan 40 which is arranged to draw in the heated air around the illuminating lamp 61 and the transparent plate 49 through a small opening (not shown) formed in the light shielding case 7 for directing the warm air flow onto the discharge tray 11 provided at the upper surface of the apparatus housing 1 through a duct 41 to dry the copied sheets 133 discharged onto the tray 11. For further improving the efficiency of drying as described above, it is preferable to provide a heating element 42, for example, of nichrome heater or honeycomb heater which shows resistance variation of positive characteristic with respect to temperatures in the duct 42 for auxiliary heating.

Referring also to FIGS. 8(a) to 9, there is shown a modification of the developing unit 26 of FIGS. 1 to 7. In this modification, the developing unit 26 further includes an improved developing solution stirring arrangement which is intended to overcome disadvantages in the conventional stirring arrangements wherein, for example, a stirring member mechanically driven separately (not shown) is disposed within the developing solution in the developing tank to form a liquid flow intersecting the transporting direction of the copy paper sheet for eliminating irregular toner concentration thereat, thus resulting in mechanical complication of the developing unit. In the developing solution stirring arrangement according to the modification of FIG. 8(a), there is provided a liquid flow guide member or projecting wall 27*a* integrally formed on the inner bottom surface of the developing tank 27 in a position adjacent to a rotary member, (i.e., the developing roller 29 in the embodiment), and extending in a direction to intersect the rotating axis of the rotary member 29 at an angle as shown, while the shallow grooves described as provided in the outer periphery of the member 29 in the embodiment of FIGS. 1 to 7 are replaced by many teeth or straight grooves 29*b* formed in the same outer periphery in a direction parallel to the axis of the member 29. It is to be noted here that, when the rotary member 29 is intended to function as the developing roller as in the embodiment, tips 29*b* of teeth or concave and convex portions formed by the grooves 29*a* are arranged to be directed in a direction opposite to the rotating direction of the roller 29 so as to form saw-tooth like configuration as is most clearly seen in FIG. 8(b). The above arrangement is particularly effective for preventing the trailing edge of the copy paper sheet from being caught in the grooves 29*a* and subsequently caused to spring up during rotation of the roller 29. Since the speed of rotation of the developing roller 29 is normally several times higher than the speed of copy paper transportation, the above inconvenience is likely to take place during development, resulting in splashing of the developing solution which may soil the reverse surface of the copy paper sheet or portions around the developing device by toner. By arranging the tips of the teeth 29*b* to be deviated as described above, the trailing edge of the copy paper sheet rides over the inclined planes of the teeth 29*b* and disadvantages as described above can be eliminated.

The developing tank 27 is so formed that edges thereof are located close to the developing roller 29 (rotary member) at least in positions where the developing solution 28 contacts surrounding air so as to reduce the contact area of the developing solution 28 with the surrounding air as far as possible, with consequent suppression of evaporation of volatile portions in the developing solution and also to improve stirring effect for the developing solution at such narrow portions between the tank 27 and the roller 29.

As is clear from the above description, according to the arrangement of the invention, part of liquid flow arising from the rotation of the developing roller is changed in its direction by the liquid flow guide member or projecting wall 27*a* of very simple structure for improving the stirring effect without employment of conventional stirring devices including complicated driving mechanism.

It should be noted here that the liquid flow guide member 27*a* described as integrally formed with the bottom surface of the developing tank 27 may be further modified to be formed by a separate member secured to said bottom surface, and that the rotary member or developing roller 29 in the form of a roller may be replaced by one having configuration of a belt or the like.

Referring also to FIG. 10, the arrangement with respect to the absorbing belt 36 is described in detail hereinbelow. Conventionally, in the similar arrangement to that in FIGS. 8(a) and 10 wherein an endless belt is, for example, movably supported by a plurality of rotatable rollers for examples rollers R1, R2 and R3 in FIG. 10, with a pressing roller member pressed against the endless belt for diving said belt and pressing roller member in directions, for example, indicated by the arrows in FIG. 10 to feed the copy paper sheet or the like in a direction of the arrow between the belt and the pressing roller member, the belt is normally moved by a roller R1 (equivalent to the roller 37*a*) mainly for increasing the contact pressure of the belt toward the pressing roller member to achieve positive transportation of the copy paper sheet. The conventional arrangements as described above have such disadvantages that, when employed for drying or fixing of a copy paper sheet bearing thereon unfixed toner images, the toner particles of the unfixed toner images tend to adhere to the surface or the like of the endless belt due to excessive contact pressure between the belt and the pressing roller member, thus undesirably giving rise to the so-called offset phenomenon. More specifically, in such conventional arrangements, since the portion of the belt between the rollers R1 and R2 in FIG. 10 is stretched at the highest tension, with consequent increase of the contact pressure of the belt with respect to the pressing roller member, the disadvantages as described above are more likely to take place.

In order to overcome the disadvantages as described above, according to the arrangement of the present invention, the absorbing belt 36 movably supported by rollers 37*a*, 37*b* and 37*c* is driven by the roller 37*b* (equivalent to the roller R2) in the direction indicated by the arrows in FIG. 10, with the roller 37*a* being urged in the direction of the arrow a by a spring S suitably connected between the roller 37*a* and a frame of the apparatus housing 1, while the pressing roller member or upper squeezing roller 35*a* pressed against the belt 36 is rotated in the direction of the arrow for feeding the copy paper sheet 133 bearing thereon unfixed toner images 133*a*. By the above arrangement of the present invention, upon comparison of the tensions at portions 36*a*, 36*b*, 36*c* and 36*d* of the belt 36, the portions 36*a* and 36*b* of the belt 36 which form the passage for the copy paper sheet 133 is driven at the least tension, thus the contact pressure of the belt 36 against the squeezing roller 35*a* being reduced as compared with that in the conventional arrangements. Accordingly, the inconvenience in the known arrangements that the toner particles on the unfixed toner images adhere to the belt 36 to give rise to the offset phenomenon is much reduced, and a highly efficient transportation arrangement for sheet materials such as copy paper sheets is presented.

It should be noted here that in FIGS. 8(a) and 10, although the belt 36 is described as supported by the three rollers 37*a*, 37*b* and 37*c* with the roller 37*a* being urged outwardly by the spring S, the number of the rollers for the belt 36, positional relation between the belt 36 and the squeezing roller 35*a* and application of the tension by the spring S may be modified in various ways depending on the necessity.

It is also to be noted that the squeezing roller 35*a* may be an independent driving roller or may be adapted to rotate following the movement of the belt 36, although the former is preferred for positive transportation of the copy paper sheet 133.

It is further to be noted that, for efficient drying and fixing of the copy paper sheet after the developing, the squeezing roller 35*a* may be replaced by a heat roller of similar configuration.

Referring now to FIG. 11, the upper portion of the apparatus housing 1 is arranged to be raised upward for opening as shown in preparation for maintenance such as removal of jammed copy paper sheet and the like. More specifically, the transfer roller 22, transportation rollers 39, press plate 30, squeezing rollers 35*a* and 35*b* and absorbing belt 36 are mounted on an upper frame 12 which is pivotally connected at one end thereof to the frames 2*a* and 2*b* of the lower half of the housing 1 by a shaft 13 for upward and downward movements about the shaft 13, while a lock lever 15 engageable with a lock pin 14 fixed at a corresponding position of the frame 10*a* of the lower half of the housing 1 is pivotally connected to the other end of the upper frame 12 by a pin 16, with the lock lever 15 which is normally biased toward the side of the lock pin 14 by a spring 17 being positioned by a stopper pin 18. Adjacent to the shaft 13 for the upper frame 12, a support lever 43 is pivotally connected, at one end thereof, to the upper frame 12 by a pin 44, while an elongated slot 43*a* of L-shape formed in the lever 43 and having a sliding portion 43*b* and engaging portion 43*c* engages a pin 19 fixed on the lower frame 2*a*. Accordingly, when the upper frame 12 is rotated upward about the shaft 13 to be opened and the pin 19 is engaged with the portion 43*c* of the slot 43a, the same frame 12 is supported by the lever 43 to be held in the opened state, with the copy paper sheet transportation passage 38 (FIG. 2) being divided into the upper and lower portions as shown.

Referring also to FIG. 12, driving system of the copying apparatus of the invention will be described hereinbelow.

A first chain 102 passed around a sprocket 101 for a drive motor 100 is directed around sprockets 104a and 104b respectively fixed to ends of the transportation rollers 46a and 46b for the original transportation unit 45 through a tension sprocket 103 suitably urged to one side by a spring, and is further passed around a sprocket 105 and an idle sprocket 106, while a gear 107 fixed to the same shaft (not shown) as that of the sprocket 105 meshes with a gear 108 secured to one end of the shaft for the photoreceptor drum 20. A second chain 110 directed around a sprocket 109 secured to the same shaft (not shown) as that of the sprocket 104b is passed around a sprocket 112 fixed to one end of the roller 37a which drives the absorbing belt 36 through a tension sprocket 111, and simultaneously around a sprocket 113 for the transportation roller 39 and a sprocket 114, while a gear 115 secured to the same shaft as that for the sprocket 112 engages a gear 116 fixed to one end of the squeezing roller 35a. A gear 117 secured to the same shaft (not shown) as that for the sprocket 14 meshes with a gear 118 fixed to the shaft of the developing roller 29. Meanwhile, a third chain 120 passed around another sprocket 119 secured to the same shaft as the sprocket 105 is directed around a sprocket 86 constituting a clutch means for the copy paper feeding roller 80.

Referring also to FIGS. 13 to 16, control mechanism of the copying apparatus G of the invention will be described hereinbelow. It is to be noted that FIG. 2 illustrates positional relation of main components of the copying apparatus G in life size or 1:1 reproduction, i.e., when the transportation speed (scanning speed) of the original to be copied and rotational circumferential speed of the photoreceptor drum 20 are equal to each other.

In the copying apparatus G according to the present invention, it is so arranged that, upon detection of the leading edge of the original by the leading edge detection switch MS-1 disposed immediately before the transparent plate 49 (FIG. 2) when the original is forwarded to an original scanning section $f$ (FIG. 14) through the original transportation rollers 47a and 47b, the illuminating lamp 61, corona charger 21 and copy paper feeding device 71 are simultaneously turned ON by the signal emitted from the switch MS-1. Accordingly, the distance $l1$ between the leading edge detection switch MS-1 and a center point $fa$ of the original scanning section $f$, distance $l2$ between a point $a$ of the photoreceptor drum 20 corresponding to a center of the corona charger 21 and a center point $b$ of the exposure section E, distance $l3$ between the point $b$ and a point $c$ whereat the transfer roller 22 contacts the surface of the photoreceptor drum 20, the distance $l5$ between the leading edge of the copy paper sheets 133 stored on the tray 72 of the feeding device 71 and the point $c$ are arranged to satisfy the following relation:

$$l1 \geqq l2 \quad \text{(i)}$$

$$l1 + l3 = l5 + \alpha \ (\alpha \geqq 0) \quad \text{(ii)}$$

The relation in the above item (i) indicates that the distance $l1$ from the detection of the leading edge of the original by the leading edge detection switch MS-1 to arrival of the same leading edge at the center point $fa$ of the scanning section $f$ is larger than or equal to the distance $l2$ from charging of the photoreceptor surface 20a of the photoreceptor drum 20 through energization of the corona charger 21 to subjection of the photoreceptor surface 20a thus charged to light images at the center point $b$ of the exposure section E, and consequently that, when the leading edge of the original reaches the center point $fa$ of the scanning section $f$, the photoreceptor surface 20a of the drum 20 corresponding to said leading edge has already been charged. Meanwhile, the relation in the above item (ii) shows that, when the leading edge of the original is detected by the leading edge detection switch MS-1 to simultaneously turn ON the illuminating lamp 61, corona charger 21 and copy paper feeding device 71, the distance $l1 + l3$ in which the original detected at its leading edge is forwarded to the center point $fa$ of the scanning section $f$ and the original image formed thereon is moved from the center point $b$ of the image forming section to the point $c$ at the transfer section is larger than or equal to the distance $l5$ ($\alpha > 0$ or $\alpha = 0$) from the leading edge of the copy paper sheets accommodated in the tray 72 to the point $c$ at the transfer section. Thus, the factor $\alpha$ indicates that even when the copy paper feeding device 71 is energized, with the driving shaft 82 started to rotate, the feeding roller 80 formed into sector shape cross section does not contact the copy paper 133 immediately and the copy paper feeding is started only after movement through a predetermined distance. Accordingly, the feeding roller 80 fixed on the shaft 82 is adapted to be adjustable in its position for proper setting depending on the length of the distance $l5$, i.e., depending on the other mechanisms of the copying apparatus G, their sizes or the like.

Additionally, the length $l6$ of the contacting portion of the copy paper feeding roller 80 should be equal to or more than the distance $l5$ ($l5 \geqq l6$) from the feeding of the copy paper 133 to transportation thereof by other transporting means, i.e., transportation thereof held between the photoreceptor drum 20 and transfer roller 22 in the above embodiment. Furthermore, the length $l6$ should be such that, while the feeding roller 80 is in the stationary state, the rear end thereof does not contact the copy paper sheet 133 with sufficient room for synchronizing adjustment. Meanwhile, the distance $\alpha$ from the tip portion of the feeding roller 80 to the point of contact of the roller 80 with the copy paper sheet 133 is in the relation, $$\alpha = (l1 + l3) - l5$$

and by adjusting the distance $l4$, synchronization between the copy paper sheet 133 and the image of the original on the photoreceptor surface 20a is effected. The microswitch MS-2 which detects the passage of the copy paper 133 is effective not only for continuation of exposing and charging functions from the passing of the trailing end of the original through the microswitch MS-1 to the complete passing thereof through the original exposure section (in this case, another detecting means may be provided in the transportation passage of the original after the original exposure section, or a timer means may be employed), but for control in the case where the length of the copy paper sheet is larger than that of the original. More specifically, in the method described in the parentheses above, if the length of the copy paper sheet is larger than that of the original, a black belt-like portion is formed at the trailing edge of the copy paper sheet due to unexposure of the photoreceptor portion between the charging section and exposure section through simultaneous stopping of the charging and exposure. Therefore, the distance $l7$ from the actuating position of the microswitch MS-2 to the point $c$ at the transfer section should be shorter than or equal to the distance $l8$ ($l7 \leqq l8$) between the leading edge of the image exposure section E of the photoreceptor drum 20 and the point c at the transfer section, and in this case, it is most preferably to make the distance $l7$ equal to $l8$ from the viewpoint of efficiency.

Subsequently, the circuit construction of FIG. 13 will be described hereinbelow with reference to a control block diagram of FIG. 15 and a time chart of FIG. 16.

In FIG. 13, when a main switch MS is closed, the driving motor MC, eraser lamp 24, heater 42, etc. are energized, while electric power is supplied also to the undernoted control circuit by a rectifier D1 through a transformer TR-1. Accordingly, the photoreceptor drum 20, each of the transportation rollers, developing roller 29, sprocket 86, dryer D are driven by the driving motor MC, and the original to be copied is ready to be forwarded to the scanning section $f$ through the transportation rollers 47*a* and 46*a*.

In the above state, when the original is inserted to be fed by the rollers 47*a* and 46*a*, the original leading edge detection switch MS-1 is closed, and currents are fed respectively to a high voltage circuit HV for the corona charger 21, the normally closed contact NC for the copy paper trailing edge detection switch MS-2, copy paper feeding solenoid 90 through a diode D2 and a capacitor C2, and the gate of a programable uni-junction transistor PUT through resistors R4 and R7, with the corona charger 21 and copy paper feeding device 71 being energized. Simultaneously, following the functioning of the programable unijunction transistor PUT, a triac T is rendered conductive through a pulse transformer P-TR and a diode D4 to turn ON the illuminating lamp 61. At this time, energization of the solenoid 90 is effected through a time-limit circuit determined by impedance values of the capacitor C2 and solenoid 90, and the solenoid 90 is automatically de-energized after a predetermined period of time.

While the original is being transported, the transportation of the copy paper sheet 133 is started by the copy paper feeding device 71, with the copy paper trailing edge detection switch MS-2 being depressed by the copy paper sheet 133 to be switched over from the normally closed contact NC thereof to the normally open contact NO. In the above state, since the solenoid 90 has already been de-energized by the time-limit circuit as mentioned earlier, with the corona charger 21 and illuminating lamp 61 being kept energized, image formation function through charging and exposing is not at all affected. When the original further transported passes through the original leading edge detection switch MS-1, the same switch MS-1 is opened, but in this state also, it is so arranged that the charger 21 and illuminating lamp 61 are kept energized through the normally ON contact of the copy paper trailing edge detection switch MS-2 until such a time that the trailing edge of the copy paper sheet 133 passes the switch MS-2 to change its contact over to the normally closed contact NC for compensating the time from the passing of the trailing edge of the original through the switch MS-1 to the arrival thereof at the center point $fa$ of the scanning section $f$.

After the copy paper sheet 133 has passed the copy paper trailing edge detection switch MS-2, the image forming mechanisms such as the illuminating lamp 61, corona charger 21 and the like are turned OFF, and the copy paper sheet 133 is transported along the processing stations such as the developing unit 29, dryer D, etc. as described earlier to be discharged onto the discharging tray 11 for completion of a series of copying operation.

In the above state, the disposing position of the copy paper trailing edge detection switch MS-2 is in the relation $$l7 \leqq l3$$

where $l7$ is the distance thereof to the point $c$ at the transfer section mentioned earlier, which relation should preferably be $l7 = l3$ for the highest efficiency. More specifically, since the position at which the copy paper 133 has passed the trailing edge detecting switch MS-2, with the illuminating lamp 61 and corona charger 21 being turned OFF to stop the image forming function, coincides with the trailing edge of the copy paper 133 at the point c of the transfer section, the electric power for the illuminating lamp 61 and corona charger 21 may be of minimum level required.

As is clear from the control block diagram of FIG. 15 related to the copy paper feeding device 71, corona charger 21 and illuminating lamp 61, the two detecting switches MS-1 and MS-2 constitute an OR circuit in the circuit diagram so as to be actuated when either of the original or the copy paper sheet is present on the detecting switches except for the function of the copy paper feeding solenoid 90, thus only two switches being required for the control.

It should be noted here that although in the foregoing embodiment, the present invention is mainly described with reference to the electrostatic latent image transfer type copying apparatus equipped with the original transporting scanning type exposure device, the concept of the invention is not limited in its application to the copying apparatus of the above described type alone, but may be applicable to any other electrophotographic copying apparatus equipped with the exposure device of original scanning type. By way of example, if the copying apparatus to which the present invention is applied is of powder image transfer type, it is only necessary to install the developing device between the exposure section and transfer section, in which case, it is preferable to arrange that the distance $l5$ between the leading edge of the copy paper sheet and the point $c$ at the transfer section is slightly large, with the value of $\alpha$ being decreased accordingly. Meanwhile, if the copying apparatus is of a type wherein the platform for the original or the optical system is moved as the original scanning means, the original leading edge detecting switch MS-1 may be so arranged as to be actuated by the movement of the original platform or by the optical system, and in such a case, a print switch for starting the copying operation is employed besides the main switch.

It should also be noted here that the separating claw 25 for separating the copy paper sheet 133 from the photoreceptor drum 20 is described as stationary in the above embodiment, the same claw 25 may be modified to be actuated in synchronization with the transportation of the copy paper 133 or in various ways to be synchronized in functioning either electrically or mechanically.

It should further be noted that although in the foregoing embodiment the copy paper sheets 133 described as employed are those preliminarily cut into predetermined length to be accommodated in a stack on the copy paper tray 72, such copy paper sheets may be replaced with copy paper in a roll form which is arranged to be cut to a required length, for example, by a cutting device disposed between the copy paper feeding device 71 and the point *c* at the transfer section, with the leading edge of the copy paper in the roll form being adapted to stop at the cut position or at a predetermined position after cutting.

Furthermore, in the arrangement of the copying apparatus of the foregoing embodiment wherein the mounting position of the copy paper feeding roller 80 of sector shape cross section on the driving shaft 82 is made adjustable in the direction of rotation for synchronization between the original and the copy paper sheet through proper adjustment of the moving distance $\alpha$ of the roller 80 from the energization of the copy paper feeding device (i.e., starting of the driving shaft 82) to the initiation of the copy paper feeding, the value $\alpha$ for the synchronization adjustment is not required to be necessarily of substantial distance, but may be replaced by time difference equivalent to the distance $\alpha$ produced by delay action of suitable clutch means or like to be employed. It is to be noted that the above time delay is effective for reduction of the size of the copying apparatus by the amount equivalent to the distance, and that the extent therefor may be suitably set depending on the necessity.

Another point to be noted here is that although in the foregoing embodiment all the distances are related to the reproduction of equal size or 1 : 1 magnification, in the copying operation of varied magnifications, i.e., in copying at *m*-time magnification also, the speeds for rotation of the photoreceptor drum 20 and transportation of the copy paper sheet are not normally varied, while the transportation speed for the original to be copied is reduced to $1/m$ of the speed at the 1 : 1 magnification, with the positions of the lens assembly 66 and mirror 64 or the mirror 65 being preliminarily altered to positions corresponding to the ratio of the varied magnification for correction of the length of light path. Accordingly, in the distances at the above state also, similar relation to that in the 1 : 1 magnification can be established if $l1$ is assumed to be $ml1$.

Furthermore, although the microswitch MS-1 provided in the original scanning section is described as directly actuated by the leading edge of the original to be copied, such a microswitch need not necessarily be actuated by the leading edge of the original, but may be modified to be actuated through movement of a reciprocatingly movable platform for the original.

Referring now to FIGS. 17 to 19, there is shown a modification of the copying apparatus of FIG. 2. In this modified copying apparatus G′, alterations are mainly effected in the original scanning section, developing unit and arrangement for dividing the upper frame of the apparatus housing as compared with the apparatus G of FIG. 2, while other arrangements are generally the same as those in FIG. 2. In FIG. 17, the copying apparatus G′ is adapted to be capable of copying thick originals such as books, and is provided, at the right hand side in FIG. 17, with a reciprocatingly movable platform 200 including a transparent plate 202, for example, of glass material for placing the thick original to be copied (not shown) thereon and a cover plate 201 for the original. The transparent plate 202 which is adapted to reciprocate horizontally by rotation of juxtaposed roller pairs 203*a* and 203*b*, and 204*a* and 204*b* is provided with a projection 202*a* which extends downwardly from the plate 202 in a position adjacent to one edge thereof within the apparatus housing for actuating the microswitch MS-1. In this arrangement, the distance between the microswitch MS-1 and a predetermined datum point *fb* of the thick original may be regarded as the distance $l1$ described with reference to FIG. 14. Since the sequence of operation thereafter is similar to that described earlier, detailed description thereof is abbreviated for brevity. It is to be noted, however, that in actual use of the platform 200, the original feeding rollers 47*a* and 47*b* (FIG. 2) are moved aside for enabling the platform 200 to reciprocate as is seen from the description with reference to FIG. 19.

In the copying apparatus G′ of FIG. 17, the developing unit 29 described as employed in the apparatus G of FIG. 2 is replaced by a modified developing unit 26′ as shown in FIG. 18, in which, in a space between the developing roller 29, and a copy paper reversing roller 35*a*′ and absorbing roller 35*b*′, another absorbing roller 32 is disposed in the upper portion, while a pair of spaced developing solution removing rods 33*a* and 33*b* are provided below and adjacent to the roller 32 as shown. The copy paper sheet 133 subjected to the developing is caused to pass between the absorbing roller 32 and the rods 33*a* and 33*b* immediately before reaching the reversing roller 35*a*′ and 35*b*′ for preliminary eliminating excessive developing solution on the image surface of the copy paper after developing. The copy paper sheet 133 is reversed while being held for transportation between the reversing roller 35*a* and the absorbing belt 36′ movably supported by the rollers 37*a*′, 37*b*′, 37*c*′ and 37*d*′, and is discharged onto the discharging tray 11 through a pair of transportation rollers 34 (FIG. 17). Part of the wall for the duct 41 in which the heater element 42′ is housed is constituted by the absorbing belt 36′, so that the copy paper 133 as well as the absorbing belt 36′ are dried by warm air flow caused by the exhaust fan 40. The developing unit 26′ further includes a rotary vane V rotatably provided in the developing tak 27′ in a position below the rods 33*a* and 33*b* for efficient stirring of the developing solution 28 contained in the tank 27′.

Referring also to FIG. 19, there is shown a modified arrangement for dividing the upper portion of the apparatus housing 1′, which is included in the copying apparatus G′ of FIG. 17.

In FIG. 19, the lower frames 2*a* and 10*a* described as separately formed in the apparatus G of FIG. 2 are replaced by a single frame 123 to which an upper cover plate 121 is pivotally connected, at one end thereof, by a shaft 122, while cover plates 124 and 125 disposed at the central upper portion of the apparatus housing 1′ are also pivotally connected to the frame 123 by pins 126 and 127 respectively. On the cover plate 124 having light shielding function also, there are mounted the transfer roller 22, separating claw 25, and microswitch MS-2, while the cover plate 125 also has a pressing plate 30 mounted thereon. For allowing the transparent plate 201 for the original platform 200 to reciprocate, the original feeding rollers 47*a* and 47*b* are moved aside as shown in chain lines in FIG. 19.

As is clear from the foregoing description, according to the present invention, since the photoreceptor drum is disposed at the central portion of the apparatus housing with the transportation passage is provided at the upper portion thereof, the transportation passage can be divided into the upper and lower portions to open for ready access by simply arranging the upper portion to be raised, and maintenance work such as removal of jammed copy paper and the like is facilitated to a large extent, while by the arrangement to feed and transport the copy paper with its image formed surface directed downward, the feeding rollers are prevented from contacting the image formed surface of the copy paper, thus the disadvantages in the conventional arrangements that the formed images are deteriorated by the frictional charging of the feeding rollers being eliminated.

Furthermore, in the copying apparatus according to the present invention, since part of the image forming optical system is disposed at the lower stage of the apparatus housing for exposing the photoreceptor drum to light images directed from downward, the optical system is accommodated in the base portion also serving for reinforcement of the apparatus housing for preventing looseness in the optical system, with consequent reduction of the size of the copying apparatus. Moreover, in the arrangement to raise the upper frame of the copying apparatus for opening, since heavy components such as the reflecting mirrors, lens assembly and the like are not required to be mounted on the upper frame, such raising portion is much simplified for ready operation.

Particularly, when the copying apparatus of the invention is of electrostatic latent image transfer type, it is not required to dispose the developing unit around the photoreceptor, with consequent reduction of the distance (equivalent to the distance *l5* in FIG. 14) between the leading edge of the copy paper sheet in the copy paper feeding device and the transfer section on the photoreceptor drum, while timing adjustment for the copy paper feeding is facilitated by the employment of the feeding roller having sector shaped cross section. Moreover, the control circuit for the copying apparatus is simplified to a large extent by disposing, in the original transportation passage and the copy paper transportation passage, the two detecting switches capable of controlling all of the copying operations such as copy paper feeding, actuations of the corona charger and illuminating lamp and the like.

Although the present invention has been fully described by way of example with reference to the attached drawings, it is to be noted that various changes and modifications are apparent to those skilled in the art. Therefore, unless otherwise such changes and modifications depart from the scope of the present invention, they should be construed as included therein.

What is claimed is:

1. An image transfer type electrophotographic copying apparatus of scanning type which comprises;

an original scanning station through which an original to be copied is scanned by an original scanning means, an optical system including an exposure lamp for projecting scanned image of the original onto a rotating photosensitive member, means provided around said photosensitive member including at least a corona charging means defining a charging station for uniformly charging the surface of the photosensitive member, an exposure slit defining an exposure station through which the projected image of the original passes, and an image transfer means defining a transfer station for transferring the image of the original formed on the photosensitive member onto a transfer material fed by a transfer material feeding means, said electrophotographic copying apparatus further including a detecting means for generating signal to simultaneously energize said exposure lamp, said corona charger and said transfer material feeding means, with a distance l1 from the generation of said signal by said detecting means to arrival of leading edge of the original at a center of said original scanning station and a distance l2 between a center of said charging station of said photosensitive member and a center of said exposure station satisfying the equation of $$ml1 \geqq l2$$

wherein $m$ is a magnification power, and with a distance *l3* between said center of the exposure station of said photosensitive member and said transfer station and a distance *l5* between a leading edge of the transfer material at transport initiating position thereof by said transfer material feeding means and said transfer starting of said photosensitive member satisfying the equation of $$ml1 + l3 = l5 + \text{distance } \alpha \ (\alpha \geqq 0)$$

said transfer material feeding means having delaying function equivalent to the distance $\alpha$ from the energization thereof by said detecting means to starting of actual feeding of the transfer material.

2. An electrophotographic copying apparatus as claimed in claim 1, wherein said original scanning means includes at least a pair of rollers for transporting the original in the form of a sheet through said original scanning station, said detecting means being provided in said original scanning station at a position deveiated form the center of said original scanning station so as to be actuated by the leading edge of the original.

3. An electrophotographic copying apparatus as claimed in claim 1, wherein said transfer material feeding means includes a rotary shaft, and a transfer material feeding roller having cross section of sector shape and mounted on said rotary shaft, said transfer material feeding roller being normally spaced from the transfer material, with distance of movement of said transfer material feeding roller from the starting of rotation thereof upon actuation of said detecting means to starting of transportation of the transfer material by said transfer material feeding roller upon contact thereof with the transfer material being equivalent to said distance $\alpha$.

4. In an image transfer type electrophotographic copying apparatus of scanning type which comprises;

an original scanning station through which an original to be copied is scanned by an original scanning means, an optical system including an exposure lamp for projecting its scanned image of the original onto a rotating photosensitive member, means provided around said photosensitive member inlcuding at least a corona charging means defining a charging station for uniformly charging the surface of the photosensitive member, an exposure slit defining an exposure station through which the projected image of original passes, and an image transfer means defining a transfer station for transferring the image of original formed on the photosensitive member onto a transfer paper fed by a transfer paper feeding means, said paper feeding means including a delay means for initiating actual feeding of transfer paper with a delay after energization of said paper feeding means, a detecting means disposed in the path of said original scanning station for generating signal to energize said exposure lamp, said corona charging means and said paper feeding means upon actuation thereof, a distance $l1$ from said detecting means to a center of said original scanning station over which the original passes and a distance $l2$ between a center of said charging station and a center of said exposure station satisfying the equation of $$ml1 \geqq l2$$

wherein $m$ is a magnification power and a distance $l3$ between said center of exposure station and said transfer station and a distance $l5$ between a leading edge of transfer paper at said paper feeding means and said transfer station satisfying the equation of $$ml1 + l3 = l5 + \alpha \ (\alpha > 0)$$

wherein the distance $\alpha$ corresponding to said delay caused by said delay means of said paper feeding means.

5. An electrophotographic copying apparatus as claimed in claim 4, wherein said detecting means is actuated by relative movement of the original and said original scanning means so as to generate said signal.

6. An electrophotographic copying apparatus as claimed in claim 5, wherein said original scanning means further includes an original transportation means and a stationary optical system, said detecting means being a switch means for detecting movement of the original.

7. An electrophotographic copying apparatus as claimed in claim 4, wherein said transfer paper feeding means further includes a rotary shaft and a transfer paper feeding roller of sector-like cross section which is adjustable in its position in a direction of rotation of said rotary shaft.

8. An electrophotographic copying apparatus as claimed in claim 4, further including a transfer paper detecting means disposed between said transfer paper feeding means and said transfer station of said photosensitive member so that at least said exposure lamp and said corona charger are de-energized through detection of a trailing edge of the transfer paper by said transfer paper detecting means.

9. An electrophotographic copying apparatus as claimed in claim 8, wherein said transfer paper detecting means is a switch means disposed in a path of the transfer paper, said distance $l3$ between said center of said exposure station and said transfer station and a length $l7$ between a position whereat said trailing edge of the transfer paper is detected and said transfer station being set to satisfy the equation of $$l7 \leqq l3$$

* * * * *